US008260573B2

(12) United States Patent
Saadatpoor et al.

(10) Patent No.: US 8,260,573 B2
(45) Date of Patent: Sep. 4, 2012

(54) DYNAMIC CALCULATION OF ALLOCATION FACTORS FOR A PRODUCER WELL

(75) Inventors: Ehsan Saadatpoor, Austin, TX (US); Hossein Karami, East Ahmadi (IR)

(73) Assignee: Schlumberger Technology Corporation, Sugar Land, TX (US)

( * ) Notice: Subject to any disclaimer, the term of this patent is extended or adjusted under 35 U.S.C. 154(b) by 414 days.

(21) Appl. No.: 12/574,835

(22) Filed: Oct. 7, 2009

(65) Prior Publication Data

US 2010/0100354 A1 Apr. 22, 2010

Related U.S. Application Data

(60) Provisional application No. 61/106,259, filed on Oct. 17, 2008.

(51) Int. Cl.
*G06F 11/30* (2006.01)
*G06F 7/60* (2006.01)

(52) U.S. Cl. ..... 702/182; 703/2

(58) Field of Classification Search ..... 702/182, 702/1–2, 6, 9, 11–14, 16, 50, 55, 81, 84, 702/155–158, 183, 189; 166/52, 244.1, 245, 166/250.1, 250.15, 252.1, 266, 268, 271, 166/305.1, 306–307, 313, 369, 373, 386; 703/2, 5, 9–10; 367/25, 73; 73/152.01–152.03, 152.18, 152.29, 152.39
See application file for complete search history.

(56) References Cited

U.S. PATENT DOCUMENTS

| | | | | |
|---|---|---|---|---|
| 6,128,579 | A | 10/2000 | McCormack et al. | |
| 6,519,531 | B1 | 2/2003 | Batycky et al. | |
| 2002/0138241 | A1 | 9/2002 | Storm, Jr. et al. | |
| 2006/0224369 | A1 | 10/2006 | Yang et al. | |
| 2009/0194274 | A1 | 8/2009 | Del Castillo et al. | |
| 2009/0306947 | A1 * | 12/2009 | Davidson | 703/2 |

FOREIGN PATENT DOCUMENTS

WO 2008/054610 A2 5/2008

OTHER PUBLICATIONS

Frorup, M., WaterFlooding Optimization Through a Better Understanding of Production Allocation, MECOM 2005, pp. 1425-1433.*

* cited by examiner

*Primary Examiner* — Toan M Le
(74) *Attorney, Agent, or Firm* — Lam Nguyen

(57) ABSTRACT

To monitor performance of wells, allocation factors are dynamically calculated for a particular producer well with respect to plural respective well patterns each including at least one corresponding injector well. The allocation factors represent a production characteristic of the particular producer well in the respective well patterns.

14 Claims, 7 Drawing Sheets

DYNAMIC CALCULATION OF ALLOCATION FACTORS FOR A PRODUCER WELL

CROSS-REFERENCE TO RELATED APPLICATIONS

This application claims the benefit under 35 U.S.C. §119 (e) of U.S. Provisional Application Ser. No. 61/106,259, entitled "CALCULATION OF PATTERN ALLOCATION FACTORS IN WATERFLOOD MONITORING," filed Oct. 17, 2008, which is hereby incorporated by reference.

BACKGROUND

To produce fluids (such as hydrocarbons, freshwater, and so forth) from a subterranean reservoir, wells can be drilled into the subterranean formation to intersect the reservoir. In a given production field, patterns of producer wells and injector wells can be drilled into the subterranean formation. Producer wells are used to produce fluids from the reservoir to the earth surface, whereas injector wells are used to inject fluids into the reservoir.

Injection of fluids (such as water) by the injector wells into the reservoir is used to aid in recovery of reservoir fluids. For example, injected water can be used to displace hydrocarbon fluid in the reservoir—the water from the injector wells physically sweeps the displaced hydrocarbon fluid to adjacent producer wells. The technique of using injected water to recover hydrocarbon fluid from a reservoir is referred to as a waterflooding technique.

During operation, an operator may monitor the waterflooding process for the purpose of making decisions regarding adjusting characteristics of the waterflooding operation. For example, fluid injection rates can be varied by the operator based on the monitoring. However, an issue associated with conventional monitoring of waterflooding operations is that various assumptions are made with respect to parameters associated the waterflooding operation, which can lead to inaccurate results.

SUMMARY

In general, to monitor performance of wells arranged in plural well patterns, allocation factors are calculated for a particular producer well, where the allocation factors represent a production characteristic of the particular producer well in respective well patterns.

Other or alternative features will become apparent from the following description, from the drawings, and from the claims.

DETAILED DESCRIPTION

In the following description, numerous details are set forth to provide an understanding of some embodiments of techniques that employ dynamic calculation of allocation factors. However, it will be understood by those skilled in the art that other embodiments may be practiced without these details and that numerous variations or modifications from the described embodiments are possible.

Figure 1:
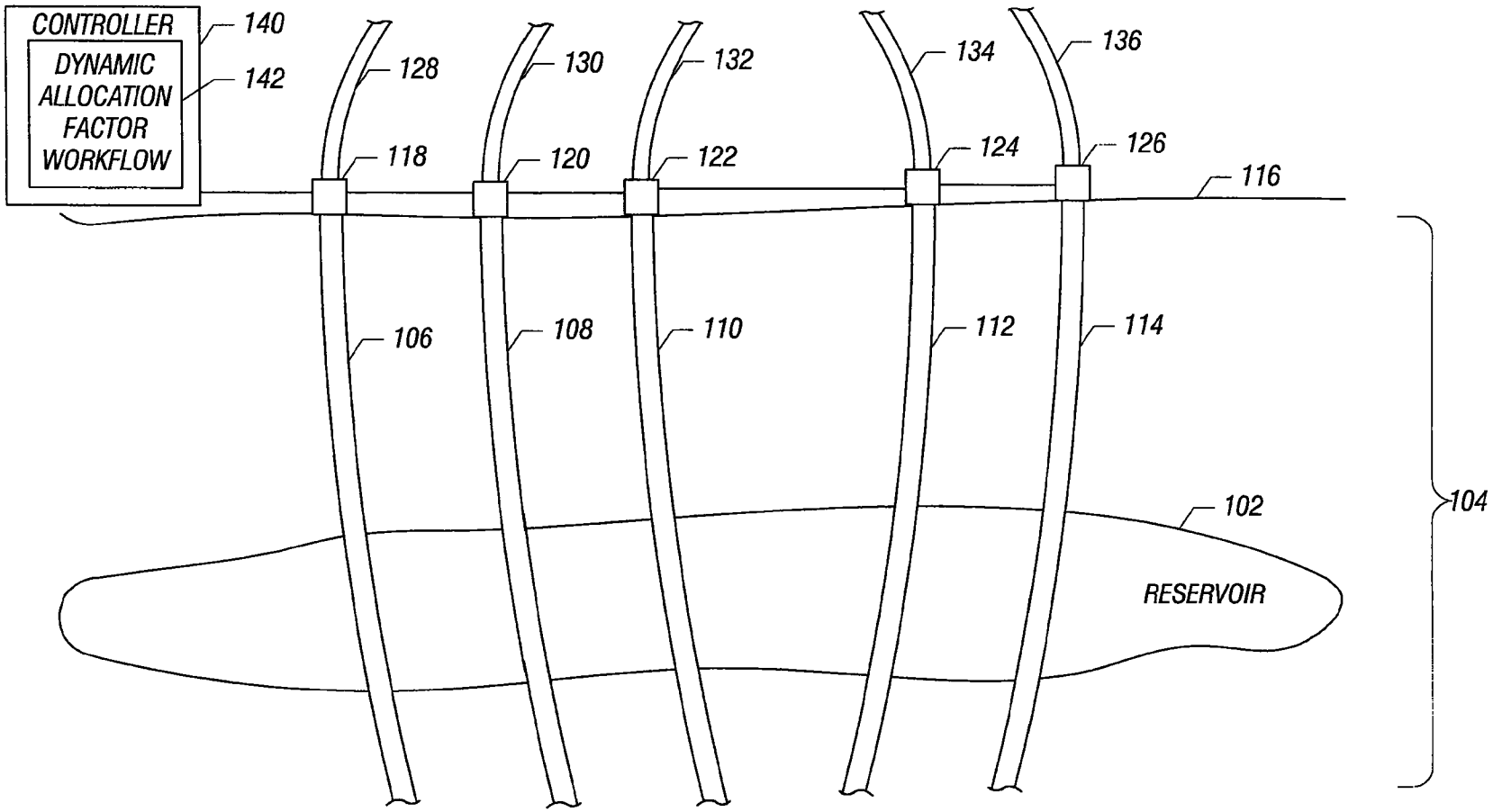
FIG. 1 is a schematic diagram of an example arrangement of wells that intersect a reservoir, and a controller to perform dynamic calculation of allocation factors according to some embodiments.

FIG. 1 is a schematic diagram of an example arrangement for producing fluids from a subterranean reservoir 102 that is located in a subterranean structure or formation 104. As depicted, various wells 106, 108, 110, 112, and 114 are drilled into the subterranean structure 104 to intersect the reservoir 102. In one example, the reservoir 102 contains hydrocarbon fluids that are to be produced to the earth surface 116. Alternatively, the reservoir 102 can contain other types of fluids (e.g., freshwater, natural gas, and so forth).

Some of the wells 106, 108, 110, 112, and 114 are injector wells (for injecting fluids into the reservoir 102), while other ones of the wells are producer wells (to produce fluids from the reservoir 102 to the earth surface 116). Each of the wells 106, 108, 110, 112, and 114 is associated with corresponding wellhead equipment 118, 120, 122, 124, and 126. The wellhead equipment 118-126 are connected to respective conduits (e.g., pipelines) 128, 130, 132, 134, and 136 for coupling the respective wellhead equipment to either a storage container to store produced fluids, or to a source container that provides a source of injection fluids. For example, a producer well will produce fluids from the reservoir, and the produced reservoir fluids will be routed through the corresponding wellhead equipment and the conduit to a storage container. On the other hand, for an injector well, fluid in a source container is provided through the corresponding conduit and wellhead equipment into the injector well for injecting the fluid into the surrounding reservoir 102.

In a more specific example, the presence of injector wells allows for performance of a waterflooding operation, in which water is injected through injector wells into the reservoir 102 to displace hydrocarbon fluids in the reservoir 102. The displaced hydrocarbon fluids are swept into adjacent producer wells, for production to the earth surface 116. In other implementations, other types of fluids can be injected into the injector wells, and other types of fluids can be produced from the reservoir 102.

As further depicted in FIG. 1, the wellhead equipment 118-126 are coupled to a controller 140, which is able to control production and injection for corresponding wells 106-114. For example, the controller 140 can control the injection rate of each of the injector wells. Also, the controller 140 can control the production rate of each of the producer wells. Controlling the production rate and injection rate of corresponding wells can be accomplished by controlling settings of valves provided in the respective wellhead equipment or downhole in the wells.

In accordance with some embodiments, the controller 140 implements a dynamic allocation factor workflow 142 that dynamically computes allocation factors. An allocation factor (or equivalently, "pattern allocation factor") refers to a proportion (often expressed as a percentage of volume) of fluids produced from a particular producer well in a given pattern of wells ("well pattern"). For example, a well pattern can have one or more injector wells and various producer wells. The various producer wells in the well pattern are each associated with a corresponding allocation factor to represent the proportion of reservoir fluids produced by the respective producer well.

The allocation factor associated with each producer well is dynamically dependent upon various characteristics associated with the injector well(s) of the given well pattern. Examples of such characteristics include the injection rate of fluid into an injector well, a distance between the injector well and the producer well, and the radius of the inner bore of the injector well.

Conventionally, allocation factors of producer wells are assumed to be static. An operator generally assigns static allocation factors to producer wells, based on empirical data and/or expert knowledge. However, the assumption that allocation factors of producer wells are static is often an incorrect assumption, since at least one characteristic (e.g., fluid injection rate) associated with an injector well that determines the value of an allocation factor may dynamically change.

The allocation factors of producer wells can be used to determine a performance parameter of a waterflooding operation. One such performance parameter is referred to as a voidage replacement ratio (VRR), which is further described below. By statically assigning allocation factors, the VRR value may be incorrectly computed, such that an operator may assume that a waterflooding operation may be proceeding in a first manner, when in fact the operation can be quite different from what is being indicated by the VRR value. As a result, the operator may make adjustments to control parameters associated with the wells that may cause sub-optimal performance of hydrocarbon production.

Figure 2A:
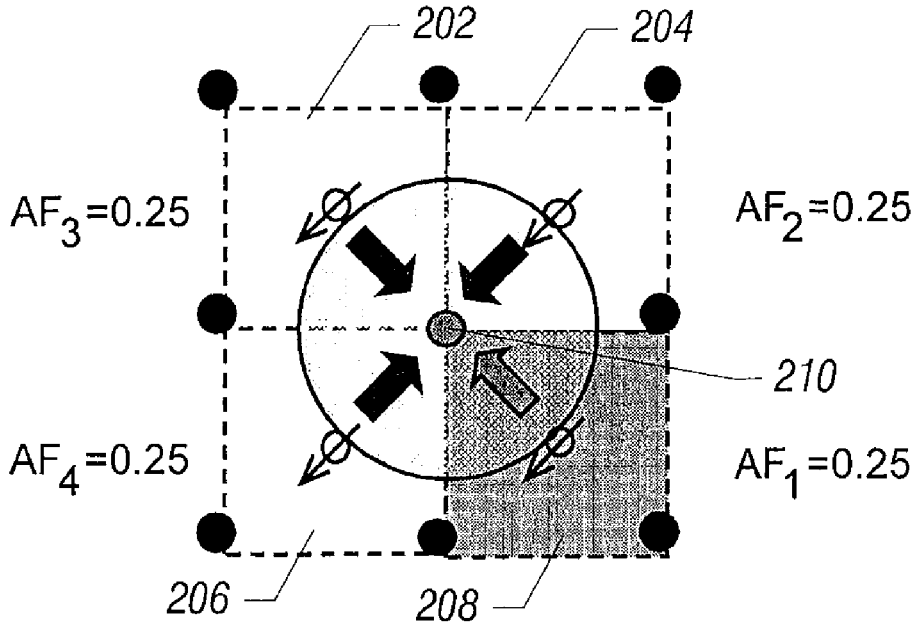
FIGS. 2A-2B illustrate example well patterns for which allocation factors can be dynamically calculated according to an embodiment.
Figure 2B:
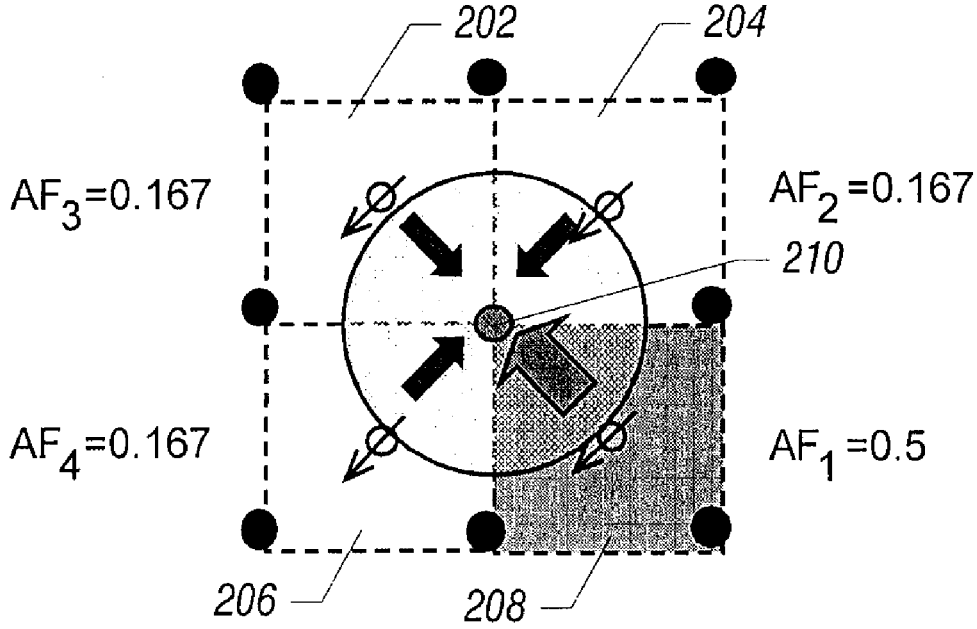

FIGS. 2A-2B illustrate example well patterns 202, 204, 206, and 208. Each well pattern 202, 204, 206, or 208 is a five-spot pattern that includes one injector well in the middle of the pattern and four producer wells at the corners of the pattern. In the example of FIGS. 2A-2B, the patterns are assumed to be generally rectangular (or square) in shape. In other implementations, patterns having other shapes can be employed.

An injector well is depicted as being an empty circle with an arrow going through the circle, whereas a producer well is represented as a filled circle. FIG. 2A shows an example in which allocation factors ($AF_1$, $AF_2$, $AF_3$, and $AF_4$) are statically assigned to a producer well 210 (which is part of each of well patterns 202, 204, 206, and 208). As shown in FIG. 2A, arrows point from each of the injector wells to the producer well 210. The allocation factor $AF_1$ represents the percentage of fluid volume produced by producer well 210 in well pattern 208; the allocation factor $AF_2$ represents the percentage of fluid volume produced by the producer well 210 in the well pattern 204; the allocation factor $AF_3$ represents the percentage of fluid volume produced by the producer well 210 in the pattern 202; and the allocation factor $AF_4$ represents the percentage of fluid volume produced by the producer well 210 in the well pattern 206.

The static assignment of allocation factor values in the FIG. 2A example can be based on pattern geometry. For example, in FIG. 2A, using pattern geometry, the percentage of volume produced from each producer well is assigned as a fraction of the total area exposed. Thus, given the pattern shown in FIG. 2A, the allocation factors $AF_1$, $AF_2$, $AF_3$, and $AF_4$ would be equal (and are assigned a value of 0.25). Such static computation of allocation factors is based on the following assumptions: the same injection rate is used in each of the four injector wells shown in FIG. 2A; and the distances between the producer well 210 and each of the injector wells shown in FIG. 2A are the same.

In practice, however, these assumptions are usually incorrect. Different injection rates can be used for different injector wells, and the distances between the producer well 210 and the adjacent injector wells may be different, since a pattern is usually not exactly symmetrical. In one example, assume that the water injection rates of the four injection wells are different. For example, the injection rate of the injector well in the well pattern 208 can be three times the injection rate in each of the injector wells in well patterns 204, 202, and 206. As a result, it can be shown that the allocation factor $AF_1$ for the producer well 210 in the well pattern 208 would be 0.5 (due to the increased injection rate of the injector well in the well pattern 208), whereas the remaining allocation factors $AF_2$, $AF_3$, and $AF_4$ are computed to have a value of 0.167.

In the example above, any performance parameter, such as VRR, that is computed based on allocation factors will have substantially different values for the case where allocation factors are statically assigned as compared to the other case where the allocation factors are dynamically calculated.

As noted above, characteristics associated with an injector well that affect the allocation factor for a given producer well include the following: the injection rate of the injector well; the distance between the injector well and the given producer well; and the wellbore radius of the injector well. In an actual field of wells, injection rates of different injector wells can be different, distances between injector wells and producer wells can vary, and wellbore radii of injector wells can vary. In one embodiment, to dynamic compute an allocation factor, it is assumed that an amount of hydrocarbon produced from a specific producer well under the effect of several injector wells is proportional to a pressure increase caused by those injector wells in the location of the producer well as predicted by the radial diffusivity equation.

Based on the radial diffusivity equation, the following simplified is coefficient ($C_i$) is computed for a given producer well:

$$C_i = q_i \ln\left(\frac{r_i}{r_{w,i}}\right),\ i = 1 \ldots n \qquad \text{(Eq. 1)}$$

where n represents the number of well patterns each including at least one corresponding injector well, $q_i$ is the injection rate of the ith injector well, $r_i$ is the distance between the producer well and the ith injector well, and $r_{w,i}$ is the wellbore radius of the ith injector well.

The allocation factor $AF_i$ for the given producer well can be computed from the coefficients $C_i$ (i=1 to n) as follows:

$$AF_i = \frac{C_i}{\sum_{i=1}^{n} C_i},\ i = 1 \ldots n \qquad \text{(Eq. 2)}$$

According to the Eqs. 1 and 2, the allocation factors for the given producer well are dynamically calculated with respect to multiple respective well patterns that each contains at least one injector well. The dynamic calculation of the allocation factors is based at least on characteristics associated with the injector wells, including $q_i$, $r_i$ and $r_{w,i}$.

In the example of FIG. 2B, the allocation factor for the producer well 210 is based on $C_i$ values computed for the four adjacent injector wells surrounding the producer well 210. Thus, in the example of FIG. 2B, the allocation factor for the producer well 210 with respect to the injector well in the well pattern 208 will be calculated as follows:

$$AF_1 = \frac{C_1}{\sum_{i=1}^{4} C_i}.$$

The other allocation factors $AF_2$, $AF_3$, and $AF_4$, are computed in similar fashion.

Figure 3:
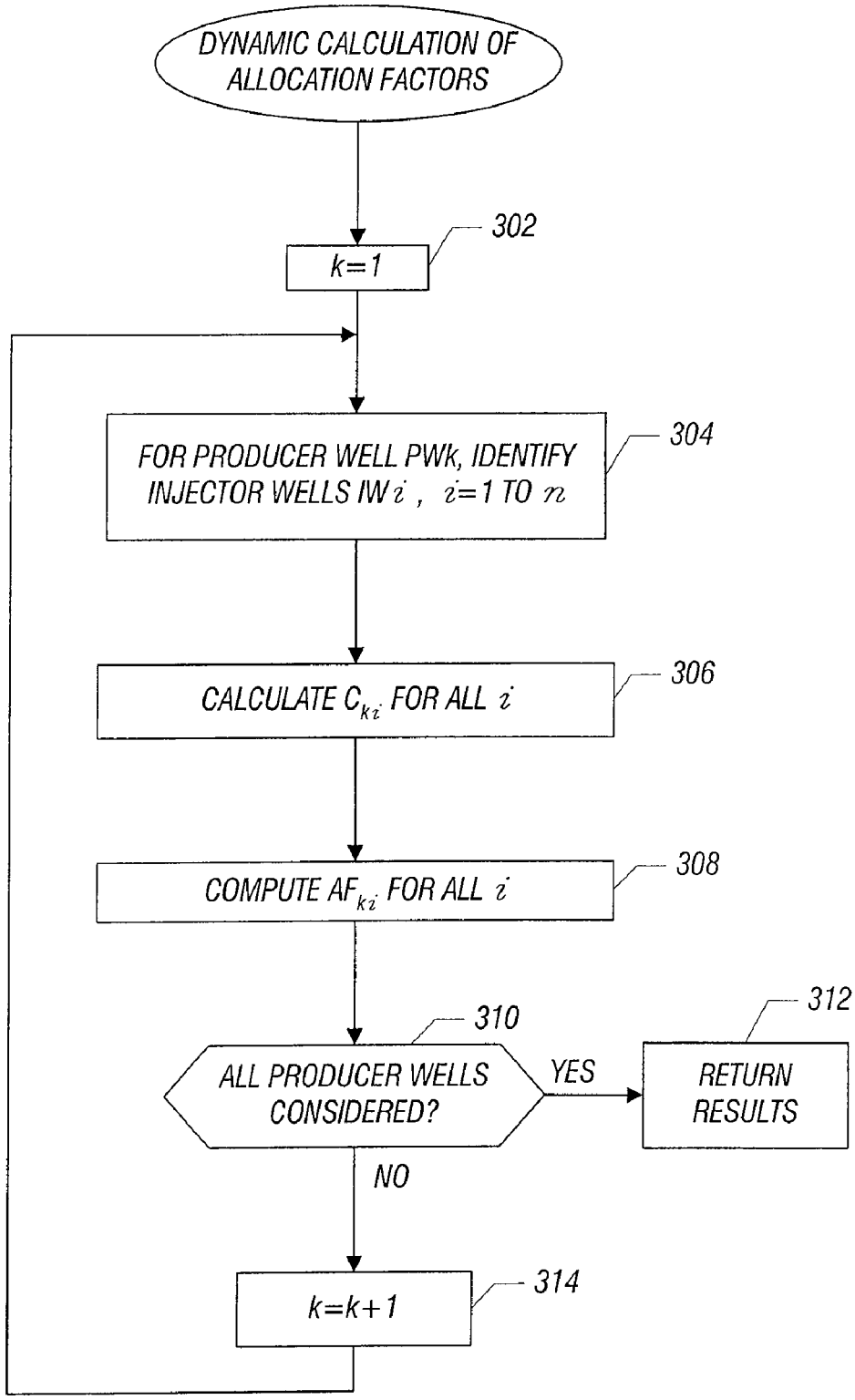
FIG. 3 is a flow diagram of a process of dynamically calculating allocation factors according to an embodiment.

An algorithm according to an embodiment for dynamic calculation of allocation factors is depicted in FIG. 3. The process of FIG. 3 can be performed by hardware or a combination of hardware and software. It is assumed that there are m (m≧1) producer wells for which allocation factors are to be calculated. For each given producer well, it is assumed that there are n (n≧1) injector wells that contribute to the computation of the corresponding allocation factor.

Initially, a variable k is set (at 302) equal to 1, to consider the first producer well. The variable k is incremented to consider successive producer wells under consideration.

For producer well PWk, the injector wells of corresponding patterns that the producer well PWk is part of are identified (at 304). The identified injector wells for producer well PWk are injector wells IWi, where i is equal to 1 to n.

For all i (i=n), the coefficient $C_{ki}$ is calculated for producer well PWk according to:

$$C_{ki} = q_i \ln\left(\frac{r_{ki}}{r_{w,i}}\right). \quad \text{(Eq. 3)}$$

Equation 3 is based on Eq. 1 above. Based on the coefficient $C_{ki}$ calculated for producer well PWk, the allocation factor of producer well PWk with respect to injector well IWi is calculated as follows:

$$AF_{ki} = \frac{C_{ki}}{\sum_{i=1}^{n} C_{ki}}. \quad \text{(Eq. 4)}$$

Eq. 4 is based on Eq. 2 above. Next, it is determined (at 310) if all producer wells have been considered. If not, the variable k is incremented (at 314), and the tasks 304, 306, and 308 are repeated for the next producer well. However, if all producer wells have been considered, as determined at 310, then the results are returned (at 312). The results include allocation factors computed for the various producer wells under consideration.

The dynamically calculated allocation factors are used to compute at least one performance measure associated with operation of the injector and producer wells. Based on the performance measure, an operator can adjust various control parameters associated with production of fluids from the reservoir 102 shown in FIG. 1. For example, one control parameter that can be adjusted is the injection rate(s) of injector well(s) that intersect the reservoir 102.

In a specific example, the operator can monitor a waterflooding operation, in which the injector wells are used to inject water into the reservoir 102 to displace hydrocarbon fluids into adjacent producer wells. In some embodiments, one monitored performance parameter associated with waterflooding operations is the voidage replacement ratio (VRR), which is computed using the dynamically calculated allocation factors. VRR represents an amount of fluid that is displaced in the reservoir 102 due to injected water through an injector well.

VRR can be calculated as follows:

$$VRR_i = \frac{Qinj_i}{Qliq_i}, \quad \text{(Eq. 5)}$$

where $VRR_i$ is the voidage replacement ratio of pattern i, $Qinj_i$ is the water injection rate in pattern i, and $Qliq_i$ is the liquid production rate in pattern i.

The liquid production rate of pattern i can be computed as follows:

$$Qliq_i = \sum_k AF_{ki} q_k, \quad \text{(Eq. 6)}$$

where $q_k$ is the fluid production rate of well k, and $AF_{ki}$ is computed according to Eq. 4 above.

Thus, as can be seen from Eqs. 5 and 6, VRR is dependent indirectly upon the allocation factors. If static allocation factors are assumed, then that may result in inaccurate computations of VRR. On the other hand, in accordance with some embodiments, by dynamically calculating the allocation factors, the VRR computations can be made more accurate.

Figure 4A:
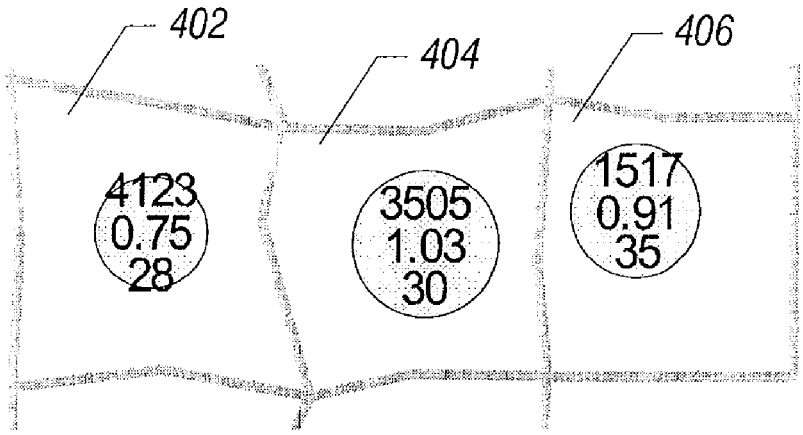
FIGS. 4A-4B illustrate various parameters associated with well patterns, where the parameters include allocation factors.
Figure 4B:
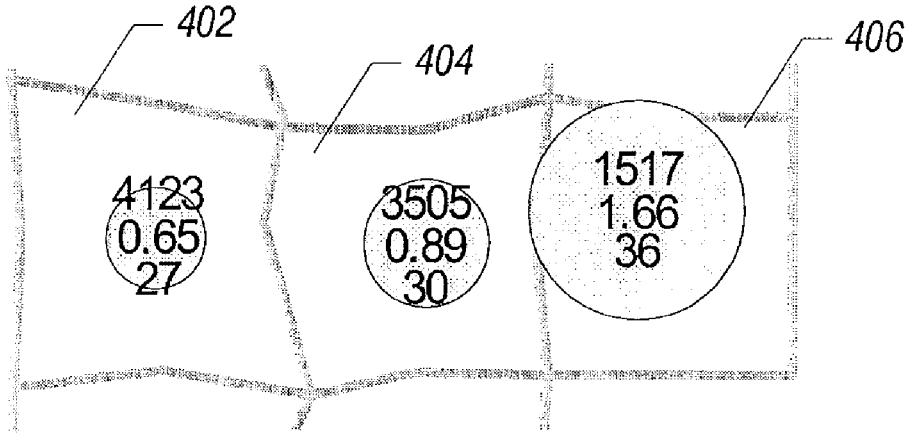

FIGS. 4A and 4B illustrate three example well patterns 402, 404, and 406. Within each well pattern is drawn a circle containing three numbers. The top number is the average water injection rate in the well pattern over some predefined time interval, the middle number is the VRR (which is in proportion with the size of bubbles in the patterns), and the bottom number is the water cut (expressed as a percentage). The water cut refers to the ratio of water produced compared to the volume of total liquids produced. Thus, for example, in FIG. 4A, the circle for well pattern 406 has an average water injection rate of 1517 (barrels per day), a VRR of 0.91, and a water cut of 35%. The computation of VRR in FIG. 4A assumes static allocation factors.

On the other hand, FIG. 4B illustrates VRRs computed based on dynamically calculated allocation factors. In the example of FIGS. 4A and 4B, the VRRs for the patterns 402, 404, and 406 differ significantly from the VRRs shown in FIG. 4A.

Figure 5:
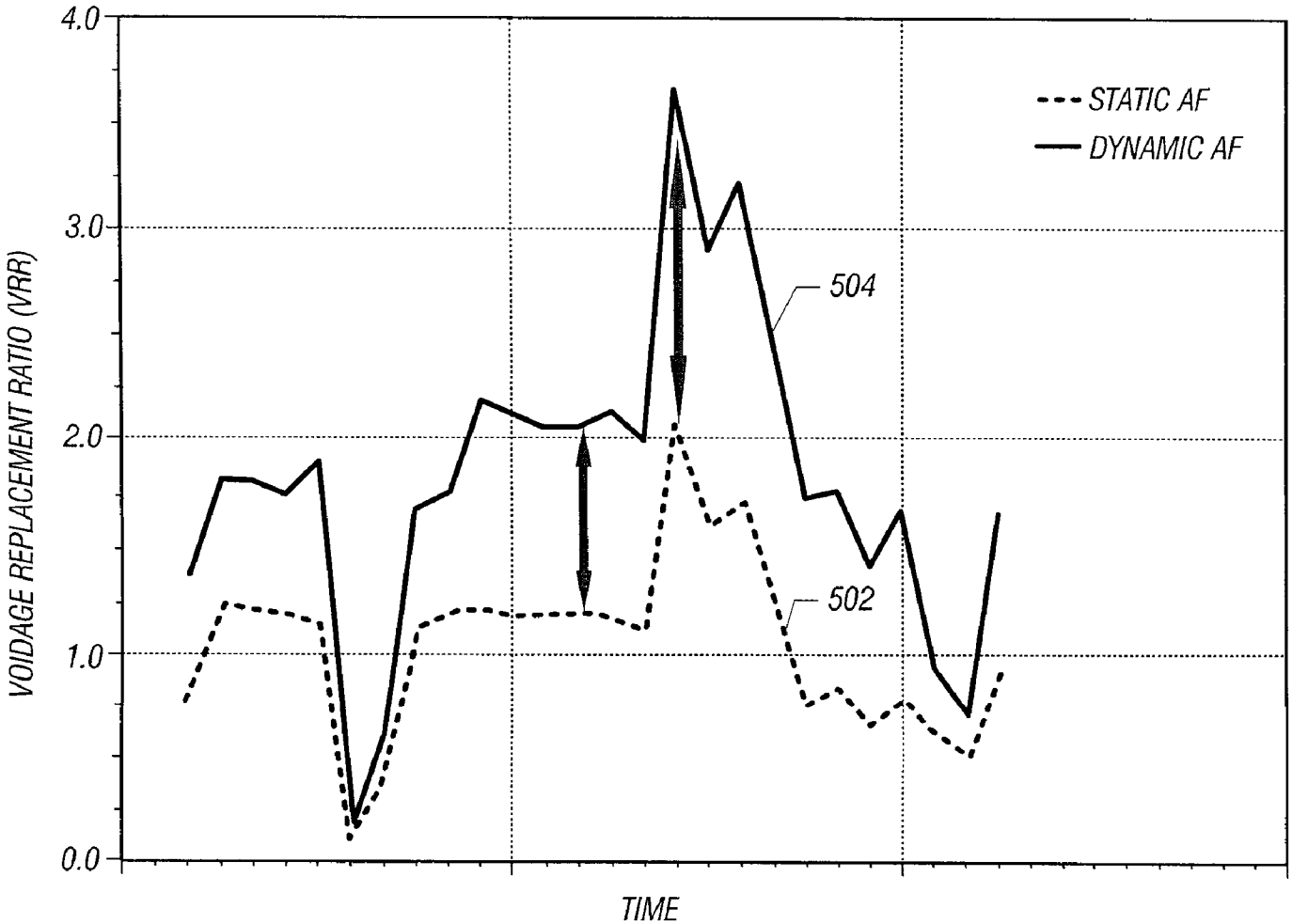
FIG. 5 is a graph illustrating voidage replacement ratio as a function of time, for statically assigned allocation factors and dynamically calculated allocation factors computed according to an embodiment.

FIG. 5 shows an example graph that plots VRR as a function of time. The dashed curve 502 represents the VRR computed based on statically assigned allocation factors, whereas the curve 504 represents the VRR calculated based on dynamically calculated allocation factors.

Generally, it is desired to maintain VRR close to a value of 1.0. Over time, the curve 502 indicates that the VRR is close to 1.0 (within a particular predefined range) when the VRR is computed based on the statically assigned allocation factors. This may prompt the operator to not make any adjustments to injection rates of injector wells, for example. However, this decision may be wrong, as indicated by curve 504, which shows that the VRR is at 2.0 or greater for a substantial amount of the time. During those periods where VRR is much greater than one, it may be desirable to reduce the injection rates in injector wells. Thus, if statically assigned allocation factors were employed, the operator may incorrectly assume that no action is needed when in fact injection rates should have been reduced based on the VRR computed according to the dynamically calculated allocation factors.

A different example may involve the VRR based on dynamically calculated allocation factors being close to the value of 1.0, while the VRR for the statically assigned allocation factors are greater than 2.0 for a substantial amount of time. In this alternative example, the operator may be prompted by the VRR computed based on the statically assigned allocation factors to reduce water injection rates, when in fact no action would have been the more appropriate response. Unnecessarily reducing water injection rates may result in reduced production performance.

Figure 6:
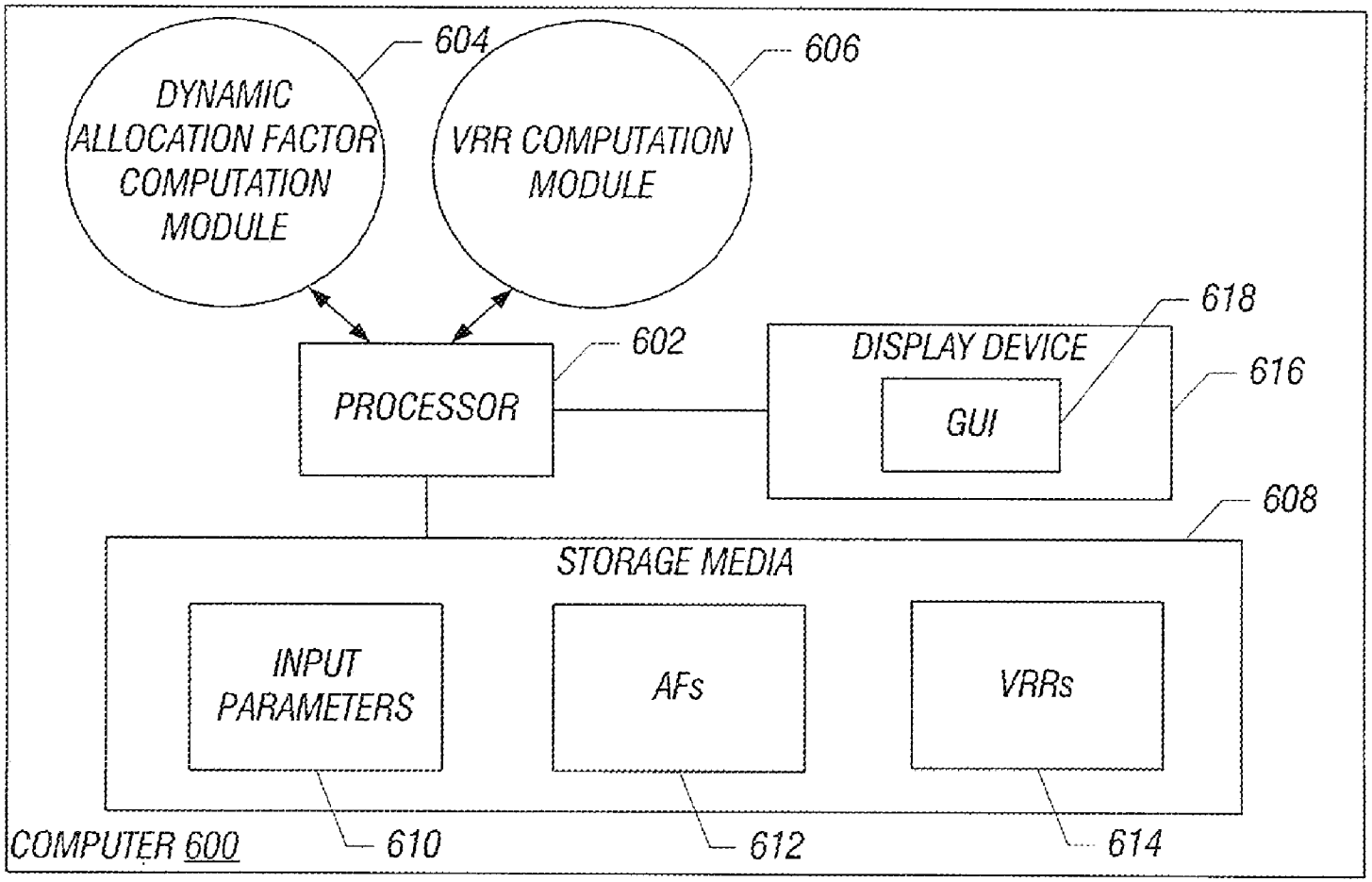
FIG. 6 is a block diagram of an example computer incorporating an embodiment.

FIG. 6 is a block diagram of an example computer 600 that includes a processor 602. The computer 600 can be used to implement the controller 140 of FIG. 1, in one example. The processor 602 is connected to storage media 608, which can contain various data records, including input parameters 610, allocation factors 612, and VRRs 614.

The allocation factors 612 are computed by a dynamic allocation factor computation module 604 that is executable on the processor 602. The dynamic allocation factor computation module 604 dynamically computes the allocation factors based on the input parameters 610, which can include injection rates of injector wells, distances between injector wells and producer wells, and wellbore radii of injector wells.

The VRRs 614 are computed by a VRR computation module 606 that is executable on the processor 602. The VRR computation module 606 calculates the VRRs 614 based on the dynamically calculated allocation factor 612.

The computer 600 further includes a display device 616, which is able to present a graphical user interface (GUI) screen 618 to display results provided by the dynamic allocation factor computation module 604 and the VRR computation module 606. The GUI screen 618 (or GUI screens) can present graphs, pattern maps, or other outputs.

Figure 7:
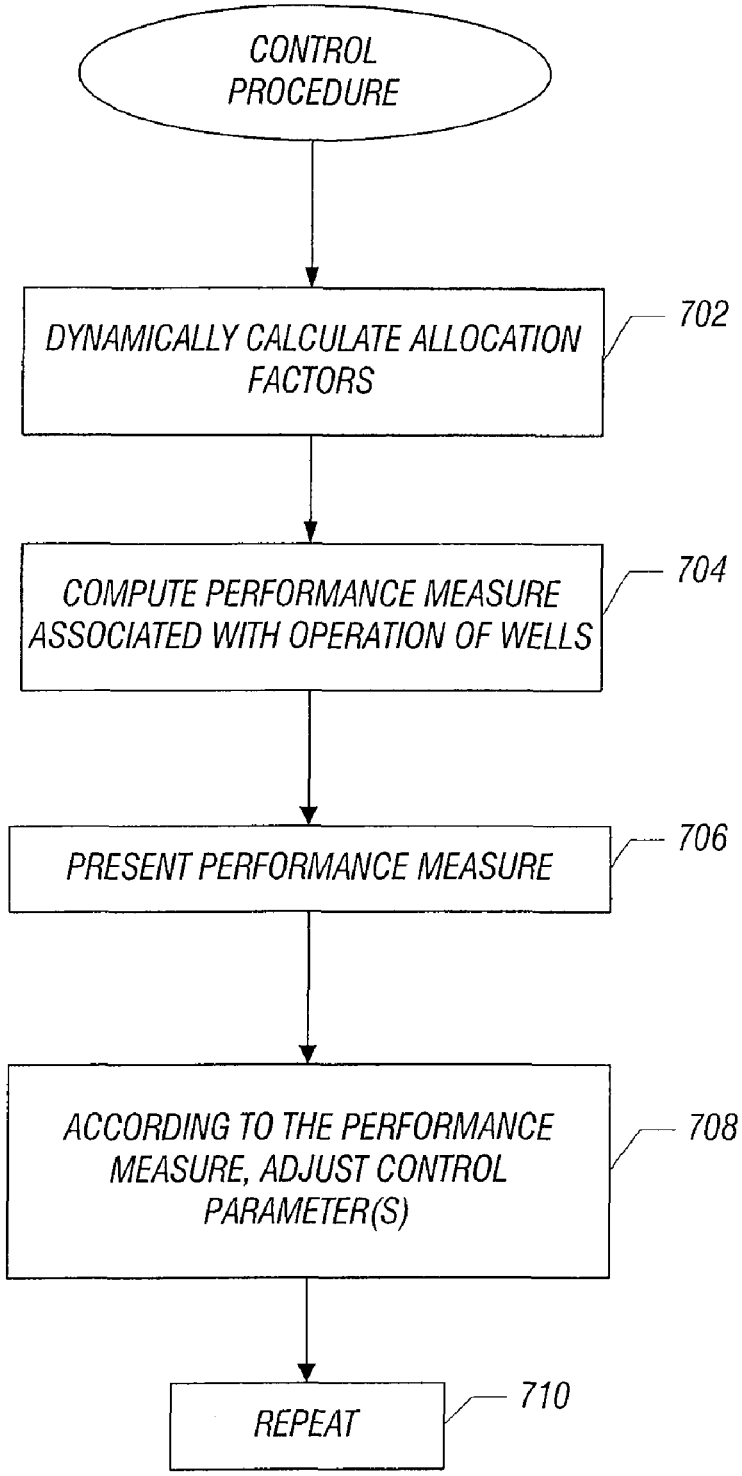
FIG. 7 is a flow diagram of a control procedure according to an embodiment.

FIG. 7 is a flow diagram of a control procedure according to an embodiment. The control procedure can be performed using the controller 140 (which can be implemented with the computer 600). The control procedure can be performed by hardware or by a combination of hardware and software.

The control procedure dynamically calculates (at 702) allocation factors, such as by the dynamic allocation factor computation module 604 (FIG. 6). Based on the dynamically calculated allocation factors, a performance measure (e.g., VRR) associated with operation (e.g., waterflooding operation) of the wells is computed (at 704). This computation can be performed by the VRR computation module 606 (FIG. 6), for example.

The performance measure is then presented (at 706), such as through the display device 616 (FIG. 6). The presented performance measure can be in graphical form (such as in the form of FIG. 5), or in some other form.

According to the performance measure, control parameter (s) associated with operation of the wells can be adjusted (at 708). This adjustment can be made by the controller 140 automatically, or in response to user input. The control procedure is then repeated (at 710) as further information regarding operation of the wells is received.

Instructions of software described above (including modules 604 and 606 of FIG. 6) are loaded for execution on the processor 602. The processor includes microprocessors, microcontrollers, processor modules or subsystems (including one or more microprocessors or microcontrollers), or other control or computing devices. A "processor" can refer to a single component or to plural components (e.g., one CPU or multiple CPUs in one or multiple computers).

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While some embodiments have been disclosed, those skilled in the art, having the benefit of this disclosure, will appreciate numerous modifications and variations therefrom. It is intended that the appended claims cover such modifications and variations.

What is claimed is:

1. A method of monitoring performance of wells, comprising:

for a particular producer well, dynamically calculating, by a processor, allocation factors with respect to plural respective well patterns each comprising a corresponding injector well, wherein the allocation factors represent production characteristics of the particular producer well in the respective well patterns, wherein each of the allocation factors is calculated based on a product of a corresponding injection rate and a natural logarithm of a ratio of a distance between the particular producer well and a corresponding injector well to a corresponding injector well radius.

2. The method of claim 1, wherein each of the allocation factors represents a proportion of fluid production from the particular producer well in a respective well pattern.

3. The method of claim 1, further comprising:

for a particular one of the well patterns, computing a voidage replacement ratio (VRR) based on the allocation factors.

4. The method of claim 3, wherein computing the VRR based on the allocation factors comprises computing the VRR based on a sum of products of the allocation factors with corresponding fluid production rates from respective producer wells.

5. The method of claim 3, wherein computing the VRR comprises computing a parameter that represents an amount of fluid displaced due to injected fluid.

6. The method of claim 5, further comprising:

adjusting a control parameter of at least one injector well in the particular well pattern according to the VRR.

7. The method of claim 6, wherein adjusting the control parameter comprises adjusting an injection rate of fluid.

8. The method of claim 6, wherein adjusting the control parameter is performed to maintain the VRR within a particular range of values.

9. The method of claim 5, wherein computing the VRR comprises computing the VRR based on dividing cumulative fluid injection in the particular well pattern by cumulative fluid production in the particular well pattern.

10. A controller to control operation of wells arranged in well patterns, comprising:

a storage media to store data related to at least one characteristic of injector wells;

a processor to:

calculate allocation factors for a particular producer well with respect to the injector wells, wherein the allocation factors represent production characteristics of the particular producer well in respective well patterns, wherein each of the allocation factors is calculated based on a product of a corresponding injection rate and a natural logarithm of a ratio of a distance between the particular producer well and a corresponding injector well to a corresponding injector well radius.

11. The controller of claim 10, wherein the processor is configured to further:

compute a performance measure of a particular well pattern based on the allocation factors; and present the performance measure to enable an adjustment of a control parameter associated with operation of the wells.

12. The controller of claim 11, wherein the performance measure is a voidage replacement ratio.

13. An article comprising at least one non-transitory computer-readable storage medium containing instructions that upon execution cause a processor to:

receive data relating to at least one characteristic of injector wells that are at least a part of patterns of wells, wherein each pattern of wells includes at least one injector well and plural producer wells; and dynamically calculate allocation factors associated with a particular one of the producer wells based on the data related to the at least one characteristic of the injector wells, wherein the allocation factors represent a production characteristic of the particular producer well in respective well patterns that the producer well is part of, wherein each of the allocation factors is calculated based on a product of a corresponding injection rate and a natural logarithm of a ratio of a distance between the particular well and a corresponding injector well to a corresponding injector well radius.

14. The article of claim 13, wherein the instructions when executed cause the processor to further:

compute a voidage replacement ratio based on the allocation factors.

* * * * *